US005222380A

United States Patent [19]

Lonati et al.

[11] Patent Number: 5,222,380

[45] Date of Patent: Jun. 29, 1993

[54] PNEUMATIC SERVICE CIRCUIT FOR CIRCULAR KNITTING MACHINE SERVICE DEVICES

[75] Inventors: Francesco Lonati; Ettore Lonati; Fausto Lonati; Tiberio Lonati, all of Brescia, Italy

[73] Assignee: Lonati S.r.L., Monza, Italy

[21] Appl. No.: 885,781

[22] Filed: May 20, 1992

[30] Foreign Application Priority Data

May 31, 1991 [IT] Italy ..... MI91A001492

[51] Int. Cl.[5] ..... D04B 15/00

[52] U.S. Cl. ..... 66/216; 66/134; 66/8

[58] Field of Search ..... 66/7, 8, 131, 134, 216

[56] References Cited

U.S. PATENT DOCUMENTS 2,222,288 11/1940 Ford ..... 66/7
3,587,251 6/1971 Vimcoli ..... 66/8
3,683,644 8/1972 Chvala et al. ..... 66/8

FOREIGN PATENT DOCUMENTS 2802080 7/1979 Fed. Rep. of Germany ..... 66/134
635710 3/1962 Italy ..... 66/8
408269 9/1966 Switzerland ..... 66/131

*Primary Examiner*—Clifford D. Crowder
*Assistant Examiner*—John J. Calvert
*Attorney, Agent, or Firm*—Guido Modiano; Albert Josif

[57] ABSTRACT

The circular knitting machine has a pneumatic service circuit with pneumatically actuated service devices arranged around the needle cylinder. An annular body surrounds the needle cylinder, and a main duct is defined in the annular body. The main duct is supplied with pressurized air and is connected to the supply ducts of pneumatic actuators which actuate the service devices. Valve for operating the actuators are arranged between the actuator supply ducts and the main duct.

3 Claims, 2 Drawing Sheets

PNEUMATIC SERVICE CIRCUIT FOR CIRCULAR KNITTING MACHINE SERVICE DEVICES

BACKGROUND OF THE INVENTION

The present invention relates to pneumatic service circuit for circular knitting machine service devices.

As is known, circular knitting machines have long used numerous pneumatic actuators in order to actuate the various service devices required for the operation of the machine, such as for example thread guides, movable cams for actuating the needles or sub-needles, extractors for oscillating selectors, selection devices, thread cutting and clamping units, etc.

Actuation of the various devices by means of pneumatic actuators is increasingly used by manufacturers of these types of machines, since it extremely simplifies the connection of the various service devices to an electronic central control unit which is capable of actuating the various devices, according to a preset program, simply by actuating electric valves arranged along the supply ducts of the pneumatic actuators.

In currently commercially available machines, the pneumatic service circuit is generally constituted by a control unit which combines all the electric valves actuated by the central unit and from which the supply ducts of the various pneumatic actuators, constituted by flexible tubes, extend.

Although the control unit is arranged proximate to the needle cylinder of the machine, the supply ducts of the various pneumatic actuators to be actuated are relatively long and constitute a bulk which must be taken into account during the design of the machine in order to avoid interference between the various ducts and the other elements required for the operation of the machine.

The length of the supply ducts, which generally have a reduced passage section, furthermore causes load losses which compulsorily require an increase in the supply pressure, which in turn necessitates the employment of valves which are oversized with respect to the pressure which is actually necessary in order to activate the pneumatic actuators.

With the pneumatic circuits which are currently used, one also observes problems during maintenance, since it is difficult to operate around the needle cylinder due to the presence of the pneumatic ducts which reach the various actuators, as well as high assembly costs due to the considerable number of pneumatic ducts and related couplings.

SUMMARY OF THE INVENTION

The aim of the present invention is to solve the above described problems by providing a circular knitting machine for manufacturing socks and stockings with a pneumatic service circuit which does not create bulk problems particularly proximate to the needle cylinder.

Within the scope of this aim, an object of the invention is to provide a machine with a pneumatic circuit wherein the ducts for supplying the various actuators are extremely short so as to cause only modest load losses.

Another object of the invention is to provide a machine with a pneumatic circuit which is simple to manufacture and requires a reduced assembly time.

A further object of the invention is to provide a machine with a pneumatic circuit which can be served by small-size actuation valves, with advantages as regards both the purchase cost and the overall bulk of the pneumatic circuit.

Another object of the invention is to provide a machine with a pneumatic circuit whose efficiency can be checked even before machine assembly is completed.

This aim, these objects and others which will become apparent hereinafter are achieved by a circular knitting machine for manufacturing socks and stockings, with an improved pneumatic service circuit, comprising a needle cylinder and service devices which are actuated pneumatically and are arranged around said needle cylinder, characterized in that it comprises an annular body which surrounds the needle cylinder and in which a main duct is defined, said main duct being supplyable with pressurized air and connected to the supply ducts of pneumatic actuators for the actuation of said service devices by means of valve elements which are controllably drivable for pneumatically connecting said supply ducts to said main duct.

BRIEF DESCRIPTION OF THE DRAWINGS

Further characteristics and advantages of the invention will become apparent from the description of a preferred but not exclusive embodiment of the machine with pneumatic circuit according to the invention, illustrated only by way of non-limitative example in the accompanying drawings, wherein.

DESCRIPTION OF THE PREFERRED EMBODIMENTS

Figure 1:
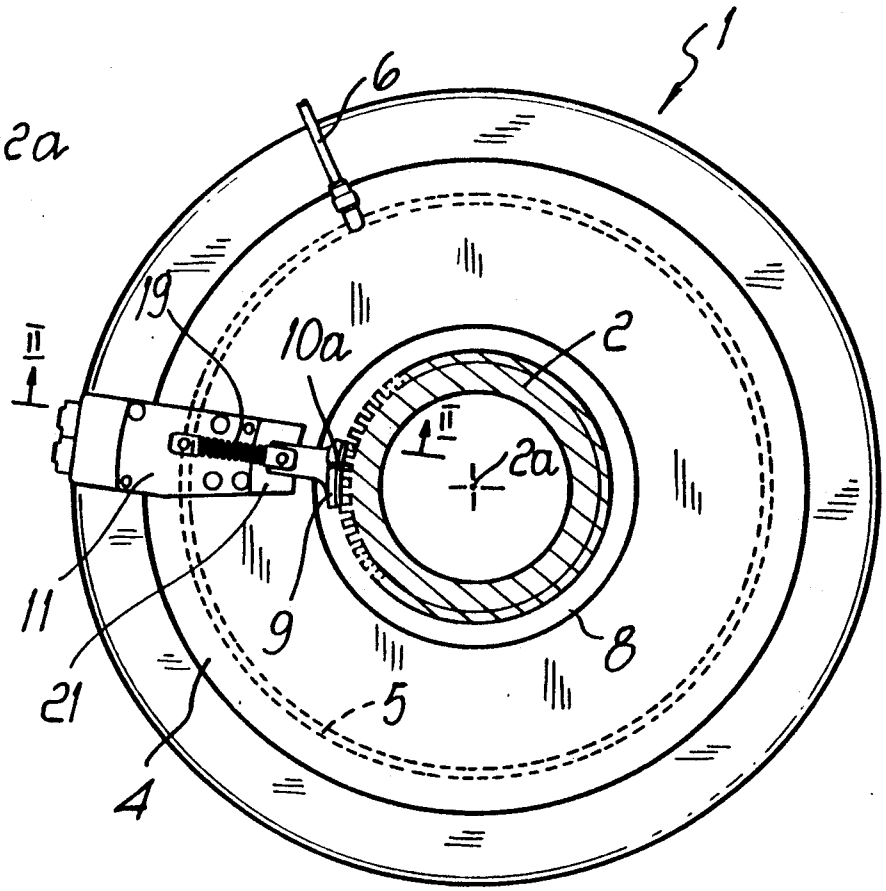
FIG. 1 is a schematic plan view of the machine according to the invention.

With reference to the above figures, the machine according to the invention, generally designated by the reference numeral 1, comprises a needle cylinder 2 which can be actuated so as to rotate about its own axis 2*a* with respect to the supporting structure 3 of the machine.

According to the invention, the machine is provided with an annular body 4 which surrounds the needle cylinder 2 and has, inside it, a main duct 5 which can be connected to a source of compressed air through a supply tube 6.

The body 4 is conveniently dish-shaped and is associated with the supporting structure of the machine by means of supports 7; a central hole 8 is defined in said body 4, and the needle cylinder 2 passes through it.

The service devices with which a knitting machine is usually equipped, such as for example thread guides, movable cams, selection devices, cutting and clamping units etc., are associated with the body 4 and are actuated by pneumatic actuators.

The supply ducts of the various pneumatic actuators are connected, according to the invention, to the main duct 5 by means of valves which can be driven so as to connect or disconnect the main duct 5 and the supply duct of the related pneumatic actuator.

For the sake of simplicity, the drawings illustrate a device for actuating a movable cam 9 which, by moving closer to or away from the needle cylinder, can engage with, or disengage from, the heel 10*a* of the needles 10.

More particularly, said device comprises a block 11 which is associated with the upper face of the body 4 and supports, so that it can slide along a direction which is radial with respect to the needle cylinder, a slider 21 to which the cam 9 is fixed.

The pneumatic actuator is accommodated inside the block 11 and is constituted by a piston 12 which can slide in a cylindrical chamber 13 which is defined in said block 11 and is connected to the slider 21 by means of its stem.

The cylindrical chamber 13 has an axis which is orientated radially with respect to the needle cylinder and is connected, proximate to its longitudinal end which is opposite to the needle cylinder, to a supply duct 14 which extends partially in the block 11 and partially in the body 4. The two portions of the supply duct are mutually connected by assembling the block 11 on the body 4, with the possible interposition of a sealing gasket 15.

The main duct 5 extends preferably along a circular path which is concentric to the body 4 and is provided with a plurality of radial branches 16 which lead onto the lateral surface of the body 4.

The portion of the supply duct 14 which extends inside the body 4 leads outside the body 4 proximate to one of said outlets of the branches 16. The outlet of each branch 16 is connected to the inlet of the supply duct of each pneumatic actuator by means of a solenoid valve 17, which is associated with the body 4 and is driven by an electronic central unit 18 which actuates the valve according to a preset program.

In the illustrated case, the solenoid valve 17 is a known two-way electric valve which selectively connects the supply duct 14 to the branch 16 or to the atmosphere.

The illustrated pneumatic actuator is in practice a single-action pneumatic cylinder, and the return of the slider 21 is obtained by means of a spring 19.

Naturally it would also be possible to use double-action pneumatic cylinders by providing two supply ducts which lead into the chamber 13 on opposite sides with respect to the piston 12 and can be connected, by means of another type of valve, to the branch 16 or to the atmosphere.

Figure 3:
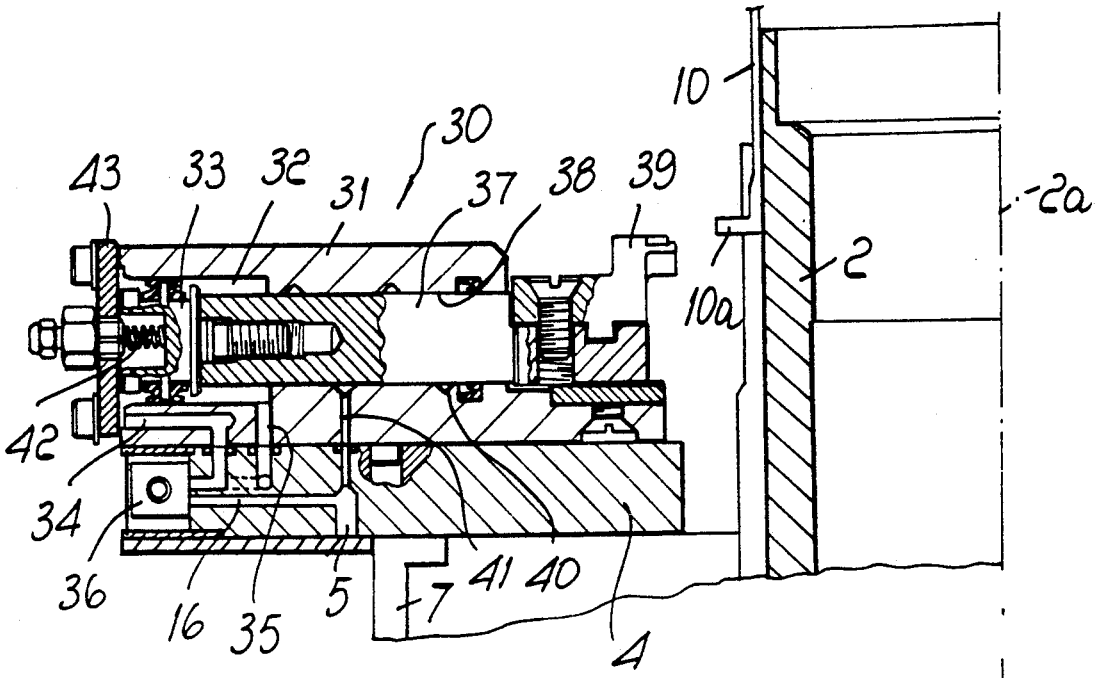
FIGS. 3 and 4 are sectional views, taken similarly to FIG. 2, of a double-action pneumatic actuator for actuating knitting cams which is connected to the annular body.
Figure 4:
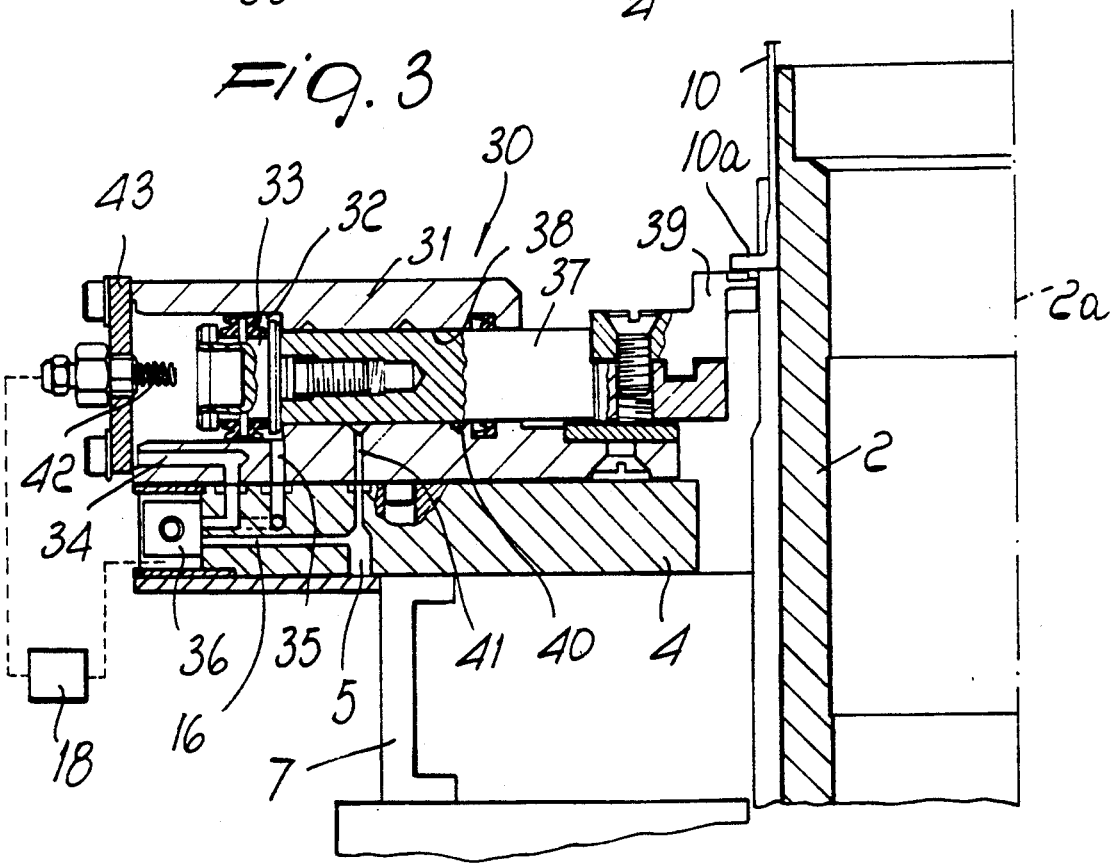

More particularly, FIGS. 3 and 4 illustrate a double-action pneumatic actuator, generally designated by the reference numeral 30, which is constituted by a block 31 inside which a cylindrical chamber 32 is defined and slidingly accommodates a piston 33. Two supply ducts 34 and 35 are defined in the body of the block 31 and lead into the chamber 32 on opposite sides with respect to the piston 33. The two ducts 34 and 35 extend into the body 4 and are connected to a solenoid valve 36 which is in turn connected to a radial branch 16 of the main duct 5. The solenoid valve 36 can be actuated, in a per se known manner, so as to selectively connect one of the ducts 34 or 35 to the main duct 5 and connect the other duct to the atmosphere, so as to obtain the movement of the piston 33 along the axis of the chamber 32 in one direction or in the opposite direction. The piston 33 has a stem 37 which is supported, so as to be slidable along its axis, in a cylindrical seat 38 which is defined in the block 31. The stem 37 has an end which protrudes from the seat 38 and has a cam 39 fixed thereto; said cam is directed toward the needle cylinder. Advantageously, at least one helical groove 40 is defined on the walls of the cylindrical seat 38 and is connected, through a passage 41 defined partly in the block 31 and partly in the body 4, to the main duct 5 so as to reduce the sliding friction of the stem 37 by means of pneumatic support or lubrication.

Mean for detecting the position of the piston 33 along the chamber 32 are furthermore provided on the bottom of the chamber 3 which is opposite to the side from which the stem 37 protrudes.

Said detection means are constituted by a spring 42 which is metallic, or in any case made of electrically conducting material, is fixed to the block 31 and extends toward the piston 33. The spring 42 is carried by a plate 43 made of electrically insulating material and, together with the piston 33, is part of an electric circuit which is connected to the central unit 18 and is closed by contact between the piston 33 and the spring 42 or opened by the separation of the piston 33 from the spring 42, thus indicating the position of the piston 33 and therefore of the cam 39.

Figure 2:
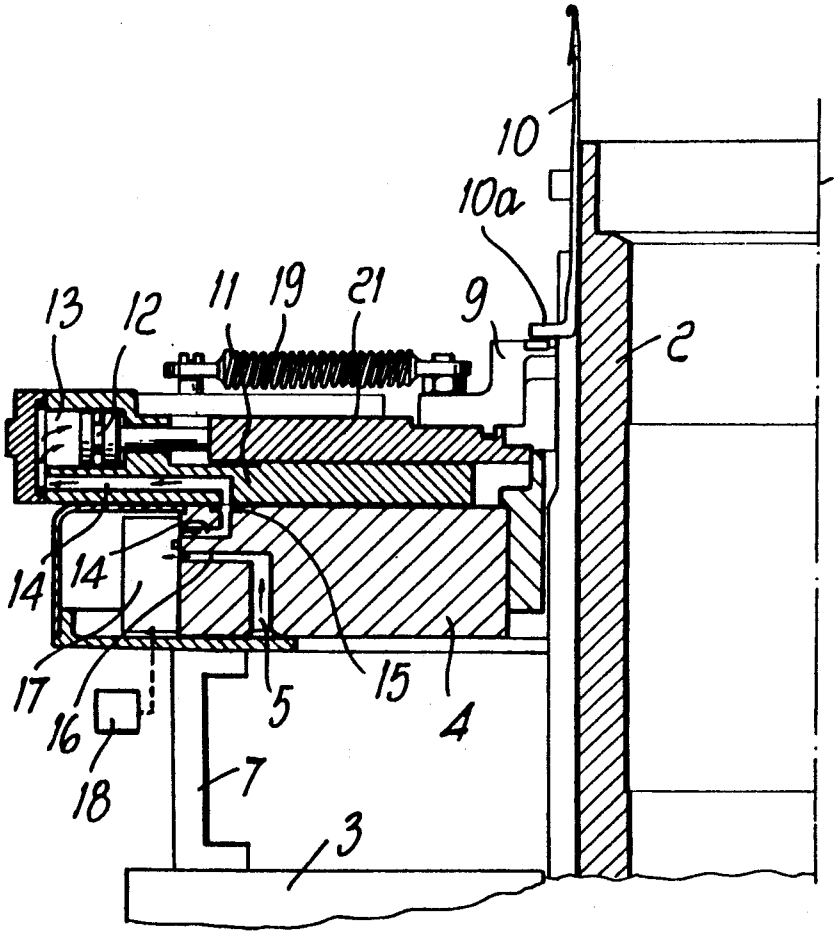
FIG. 2 is an enlarged sectional view of FIG. 1, taken along the axis II—II.

The operation of the machine according to the invention as regards the pneumatically actuated service devices, with reference to the illustrated embodiment in FIGS. 1 and 2, is as follows.

During the operation of the machine, the main duct 5 is connected to a source of compressed air.

The valves of the service devices which are not actuated are kept in such a position as to close the branch 16 and connect the related supply duct 14 to the atmosphere.

When the actuation of one of said devices is required, the central unit 18 switches the position of the valve, connecting the supply duct 14 to the branch 16.

In practice it has been observed that the machine with the pneumatic circuit according to the invention fully achieves the above described aim and objects, since it eliminates the need to use a large number of ducts made of flexible tube in order to supply the actuators of the various service devices, thus avoiding bulk problems and significantly reducing load losses. Due to this reason, it is possible to feed the pneumatic circuit at a lower pressure with respect to the pressure required for the circuits used in known machines, achieving a saving in operating costs and in the costs of the valves.

A further advantage is that it is possible to perform checking operations during assembly and maintenance interventions in an extremely simple manner.

The machine with the pneumatic circuit thus conceived is susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

We claim:

1. Circular knitting machine for manufacturing socks and stockings with an improved pneumatic service circuit, comprising a needle cylinder, service devices actuated pneumatically and being arranged around said needle cylinder, an annular body surrounding the needle cylinder, a main duct defined in said annular body, said main duct being supplyable with pressurized air and connected to supply ducts of pneumatic actuators, said pneumatic actuators actuating said service devices through valve elements, said valve elements being controllably drivable for pneumatically connecting said supply ducts to said main duct, wherein said valve elements are constituted by solenoid valves.

2. Machine according to claim 1, wherein said pneumatic actuators comprise pneumatic cylinders, each of said pneumatic cylinders having an axial seat and accommodating a piston having a stem, said axial seat slideably accommodating the stem of said piston, a helical groove being defined on a surface of said axial seat, said groove being connected to said main duct for pneumatically supporting said stem.

3. Machine according to claim 2, further comprising means for detecting a position of the piston of said pneumatic cylinders.

* * * * *